US007047677B2

(12) United States Patent
Rambaldi

(10) Patent No.: US 7,047,677 B2
(45) Date of Patent: May 23, 2006

(54) KEEPSAKE BOOK

(76) Inventor: Cherese Rambaldi, 19 Dickinson Ct., Ledgewood, NJ (US) 07852

( * ) Notice: Subject to any disclaimer, the term of this patent is extended or adjusted under 35 U.S.C. 154(b) by 15 days.

(21) Appl. No.: 10/456,669

(22) Filed: Jun. 5, 2003

(65) Prior Publication Data

US 2004/0244238 A1 Dec. 9, 2004

(51) Int. Cl.
*G09F 1/10* (2006.01)

(52) U.S. Cl. ..... 40/124.2; 40/124.13; 40/382

(58) Field of Classification Search ..... 40/124.2, 40/124.13, 382, 391, 534; 446/147, 148; 281/38

See application file for complete search history.

(56) References Cited

U.S. PATENT DOCUMENTS 1,084,349 A * 1/1914 Krumming ..... 40/404
1,333,231 A * 3/1920 Ulrich ..... 40/391
1,431,714 A * 10/1922 Wilking ..... 206/311
4,091,987 A 5/1978 Cone
4,454,980 A 6/1984 Poehler
4,514,182 A 4/1985 VerMehren
4,706,396 A 11/1987 Nomura
6,431,606 B1 * 8/2002 Lowe et al. ..... 281/38

* cited by examiner

*Primary Examiner*—Joanne Silbermann
(74) *Attorney, Agent, or Firm*—Cohen, Pontani, Lieberman & Pavane

(57) ABSTRACT

A keepsake book such as a wedding guest book includes a fanfolded carrier sheet having a plurality of envelopes affixed to alternate sections of the sheet so that the envelopes overlap shingle fashion with a portion of each envelope exposed when the carrier sheet is unfolded, and so that the envelopes form a stack when the carrier sheet is folded. The front portion of each envelope adjacent to the bottom edge is adhered to a respective alternate section of the carrier sheet so that the flap of the envelope is exposed when the flap is folded against the back side of the envelope and the carrier is unfolded, the flap being provided with a tag having lines on which identifying information can be entered. Opposite ends of the carrier are fixed to respective front and back covers of the book, which can be closed against opposite sides of the stack of envelopes when the carrier is folded. A decorative ribbon may be fixed to one of the covers for fixing the covers against the stack so that the book cannot fall open when not in use.

20 Claims, 6 Drawing Sheets

KEEPSAKE BOOK

BACKGROUND OF THE INVENTION

1. Field of the Invention

The invention relates to a keepsake book, in particular a guest book of the type which is typically signed by guests at a wedding reception or other celebration marking a significant life event.

2. Description of the Related Art

Guest books are extremely conventional insofar as they typically include plain or lined pages which are bound between hard covers, the only options typically being the size of the book, the design of the covers, a motif on the pages, and the quality of the paper.

These books are often used by guests not only to record their names, but also to enter some brief sentiment such as best wishes or a shared memory. However the conventional books do not offer any opportunity to enclose a private note, a photograph, money, or a trinket.

A keepsake book with envelopes in lieu of pages is not known. Such a book would offer guests the opportunity to include a private handwritten note, a photograph, or a small gift.

SUMMARY OF THE INVENTION

The keepsake book according to the invention utilizes a fanfolded carrier sheet having alternating first and second sections bounded by parallel folds. As used herein, the term "fanfolded" refers to a carrier sheet which is folded zig-zag fashion to form first and second sections or pleats which are separated by folds. A plurality of envelopes are fixed adjacent their bottom edges to respective ones of the first or second sections so that a portion of each envelope adjacent to its top edge is exposed when the carrier sheet is unfolded to a display configuration. It is preferable for the front side of each envelope to be fixed to the carrier sheet so that the flap of each envelope will be exposed when the carrier sheet is unfolded and the flap is folded from the top edge against the back side of the envelope. The carrier has opposed ends which are fixed to respective front and back covers to create a book which can be closed so that the envelopes form a stack between the covers, the bottom edge of each envelope being sandwiched between respective first and second sections.

According to a further embodiment of the keepsake book, additional envelope capacity is obtained by providing a second fanfolded carrier with a second plurality of envelopes attached thereto in a fashion similar to the first carrier, the second carrier only being fixed to the back cover, so that the front cover may be closed over two stacks of envelopes. The envelopes are preferably fixed to the second carrier so that they are mirror symmetric to the envelopes fixed to the first carrier when the two carrier sheets are open to extend oppositely from each other, in particularly so that the flaps in each plurality point to the flaps in the other plurality when the flaps are folded against the back sides of the envelopes.

As suggested by the basic structure outlined above, the keepsake book can be opened so that the carrier is unfolded, albeit not necessarily flat, and the envelopes overlap like shingles to create an attractive array with portions of each envelope exposed so that the flaps are readily accessible. According to the second embodiment, there are two such arrays. Each flap may be provided with a tag having at least one information line, such as name and address lines to be filled out by a guest. Note sheets may be provided so that each guest can write out a personal message for the guests of honor. A photographer may be on hand to take photos of the guests for placement in the envelope, or an instant camera may be provided for guests to take their own photos. It is also possible for guests to leave a gift such as cash or a trinket in the envelopes. Guests may be advised in advance to bring a favorite poem, childhood photograph, or prewritten message to be placed in an envelope, thereby creating a trip down memory lane for the guest of honor.

One of the advantages of using a fanfolded carrier as a binding for the keepsake book, is that objects such as jewelry may be placed in the envelopes without unduly stressing the binding when the book is closed. Another advantage is the ability to flip the envelopes like pages of a conventionally bound book without opening the carrier sheet to a display configuration.

The keepsake book according to the invention may be designed not only for use as a guest book at weddings or showers, but may also be designed for use as a child memory book, with notes and photographs or a child's early artwork and writings placed in the envelopes.

Regardless of the use of the keepsake book, it provides a vehicle for storing different types of memorabilia and does not require any mounting by tape or staples. Additionally, it protects writings and photos from exposure to light and forces them to lie flat, so that they will not fade or curl after years of storage. When viewed years later, it can provide a trip down memory lane in the nature of a treasure hunt, the contents of many envelopes having been long forgotten.

As a broad concept, envelopes attached to fanfolded carrier sheets are known. U.S. Pat. No. 4,091,987 to Cone discloses a fanfolded carrier sheet to which the flaps of envelopes are lightly attached to alternate sections by glue spots. When the carrier sheet is laid flat with the envelopes closed, the lower portions of the front sides of the envelopes are exposed for printing, the sheet being provided with traction holes for drawing through a printer. After printing, the envelopes can be removed en masse by stacking the envelopes and pulling the carrier away from them.

U.S. Pat. No. 4,514,182 to VerMehren also discloses a fanfolded carrier with envelope flaps removably attached by glue spots, and further discloses letter sheets removably attached and overlapped by the envelopes. When the carrier sheet is laid flat with the envelopes closed, both the front sides of the envelopes and the letter sheets are exposed for printing. Here, too, the carrier is provided with traction holes for drawing the carrier through a printer.

U.S. Pat. No. 4,454,980 to Poehler also discloses a fanfolded carrier sheet to which envelope flaps are removably attached. When the carrier sheet is laid flat with the flaps open, the lower portion of the back sides of the envelopes are exposed for printing, the envelopes being printed with information regarding monthly payments to be sent to a common addressee. Once again the sheet is provided with traction holes for drawing through a printer.

The arrangements disclosed in each of the above patents are directed exclusively to automated printing of envelopes which are intended to be removed from a fanfolded carrier sheet. In each case the flaps are attached to the carrier so that the bottom portions of the envelopes, whether the front or the back, are exposed for printing.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
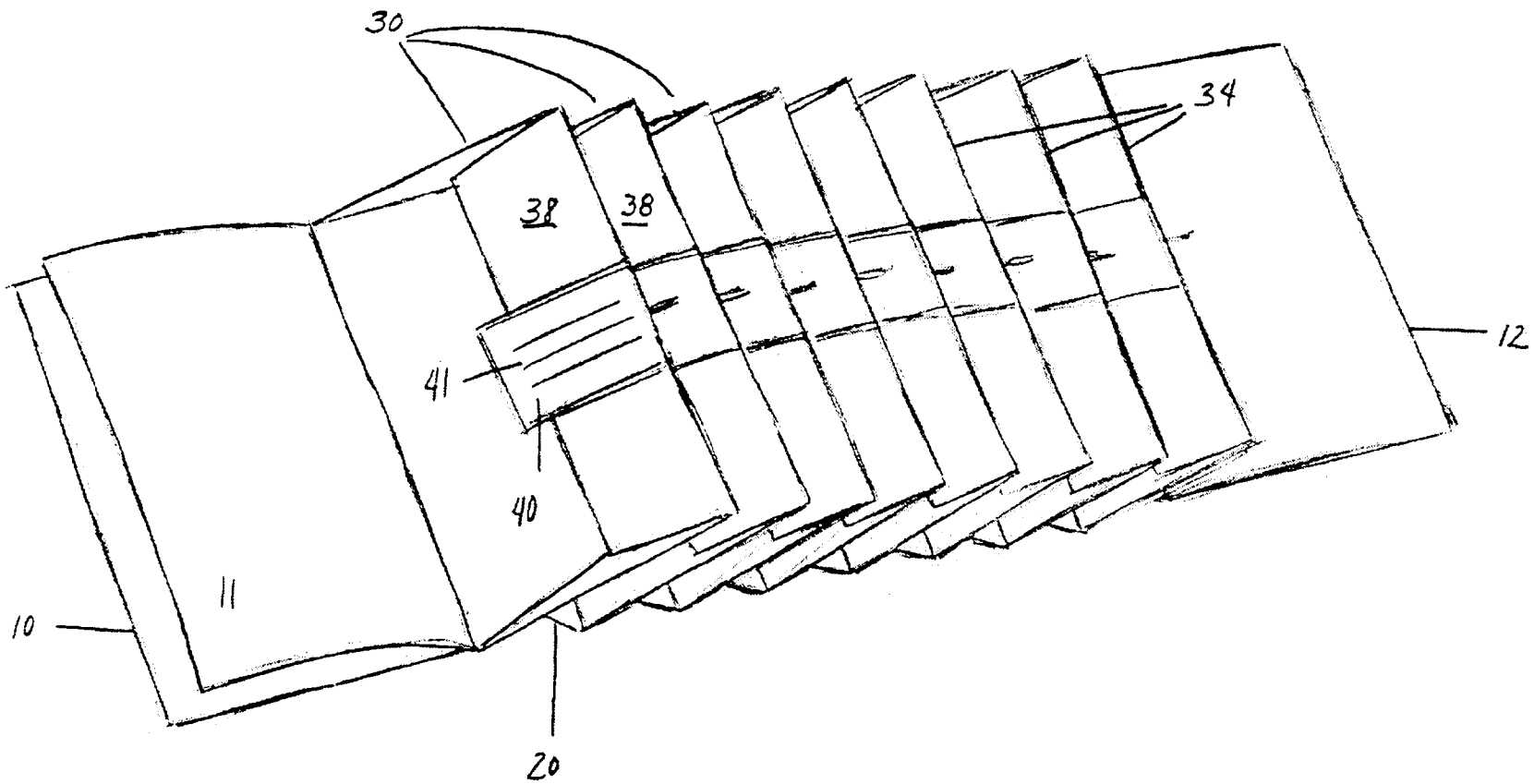
FIG. 1 is perspective view of a first embodiment of the keepsake book according to the invention in an open condition.

Referring to FIG. 1, a keepsake book according to the invention includes a front cover 10, a front fly sheet 11, a back cover 12, a carrier sheet 20, and a plurality of envelopes 30 fixed to the carrier 20. In the display state of the book, the envelopes overlap in shingle fashion so that the top edges 34 of the envelopes are spaced apart, and the flaps 38 are exposed. Each flap 38 has a name tag 40 fixed thereto, the name tags having name and address lines 41. In use, as each tag is signed or otherwise provided with information, and the envelopes 30 may be turned as pages of a book to lie in a stack against the front cover 10.

Figure 2:
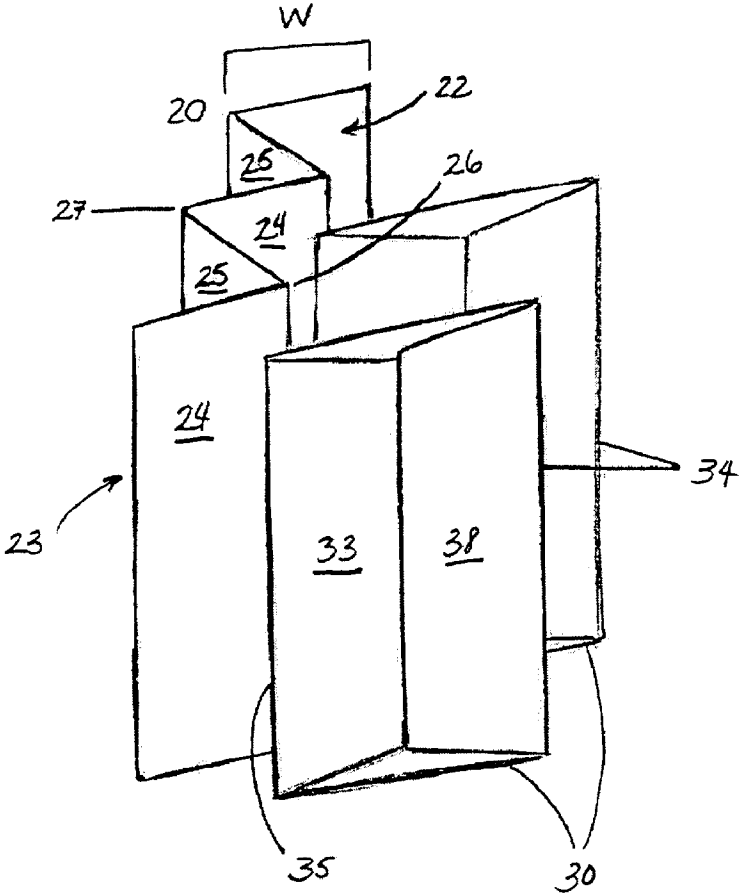
FIG. 2 is an exploded perspective of part of the carrier and envelopes.

FIG. 2 shows a section of the carrier sheet 20 and two of the envelopes 30 prior to fixing to the carrier. The carrier sheet 20 has a top side 22, an opposed bottom side 23, alternating first and second sections 24, 25, first folds 26 dividing each pair of first and second sections 24, 25, and second folds 27 separating the pairs. The carrier is characterized as a fanfolded carrier because it is folded in a zig-zag manner to resemble a handheld fan or accordion. The envelopes each have a front side 32 (not visible), a back side 33, a top edge 34, an opposed bottom edge 35, and a flap 38 which is shown folded from the top edge 34 against said back side 33 so that it covers an opening (not visible) adjacent to the top edge. To fix the envelopes 30 to the carrier 20, glue is applied to the front sides of envelopes adjacent to the bottom edges 35, and the glued portions are pressed against the front sides of respective first sections 24 of the carrier 20.

Figure 3:
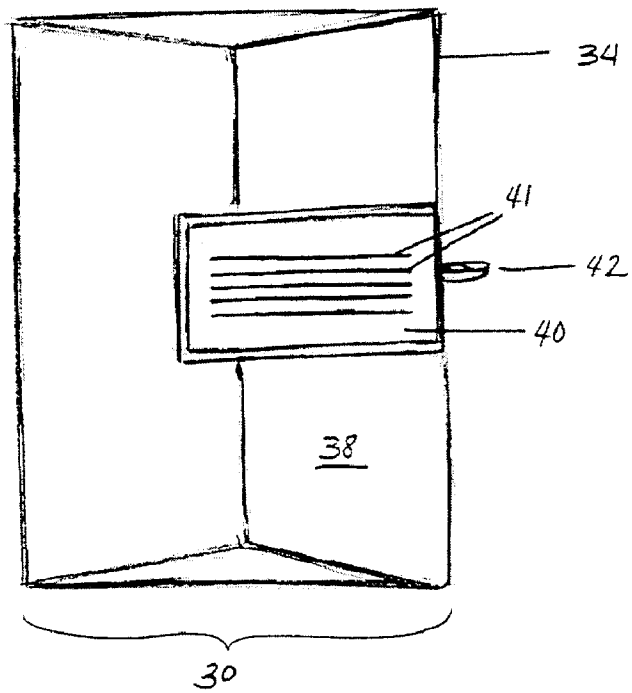
FIG. 3 is a plan view of an envelope.

FIG. 3 shows an envelope 30 in greater detail. Tags 40 are fixed to the flaps 38 so that the lines 41 extend transversely to the edges 34 of the envelopes. A pull tab 42 is also provided at the top edge 34 of each envelope to facilitate turning the envelopes as pages and for aesthetics. Each pull tab 42 is preferably formed as a loop of ribbon whose ends are sandwiched between the tag 40 and the flap 38. The tags are preferably adhered to the envelope flaps 38 by permanent glue, which also retains the loop ends.

Figure 4:
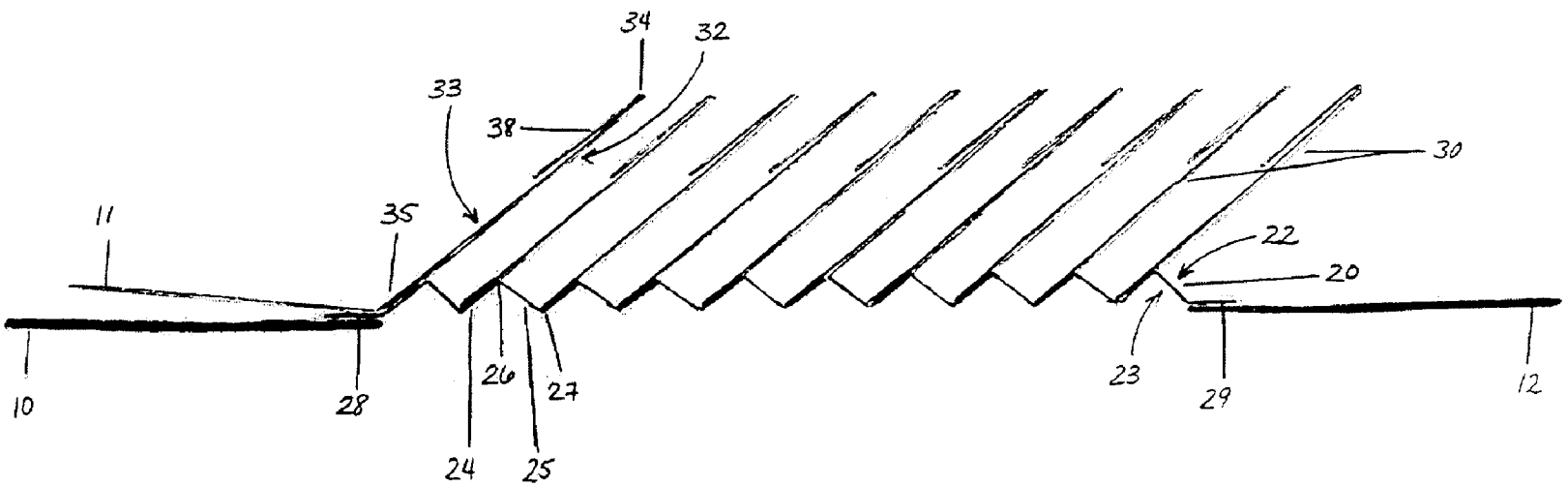
FIG. 4 is a schematic end view of the first embodiment in a partially open condition.

FIG. 4 is a schematic end view of the first embodiment of keepsake book according to the invention, which shows the invention as a whole to good advantage. The front cover 10 and back cover 12 are shown lying flat against a table or the like, with the fly leaf 11 visible. The fanfolded carrier sheet 20 has a first end 28 attached to the front cover 10, and a second end 29 attached to the back cover 12. These ends 28, 29 may be formed as flaps which are glued against the respective covers and overlain by liners. The carrier sheet 20 has a top side 22 to which the envelopes 30 are adhered, and an oppositely facing bottom side 23. First sections 24 alternate with second sections 25, the sections being separated by parallel folds 26, 27, the envelopes being adhered by their front sides 32 adjacent their bottom edges 35 to respective first sections 24. In the embodiment shown, each flap 38 extends from a top edge 34 toward the left when the flap is folded against the back side 33 of the envelope. However it is also possible to adhere the envelopes to the second sections 25 so that each flap extends from a top edge 34 toward the right, as shown in a second embodiment. Instead of adhering the front sides 32 to the first sections 24, as shown, it is also possible to have the back sides 33 adhered to the second sections 25, however, this would not result in the flaps being exposed when the book is open and the flaps are closed, and is therefore less desirable.

Figure 5:
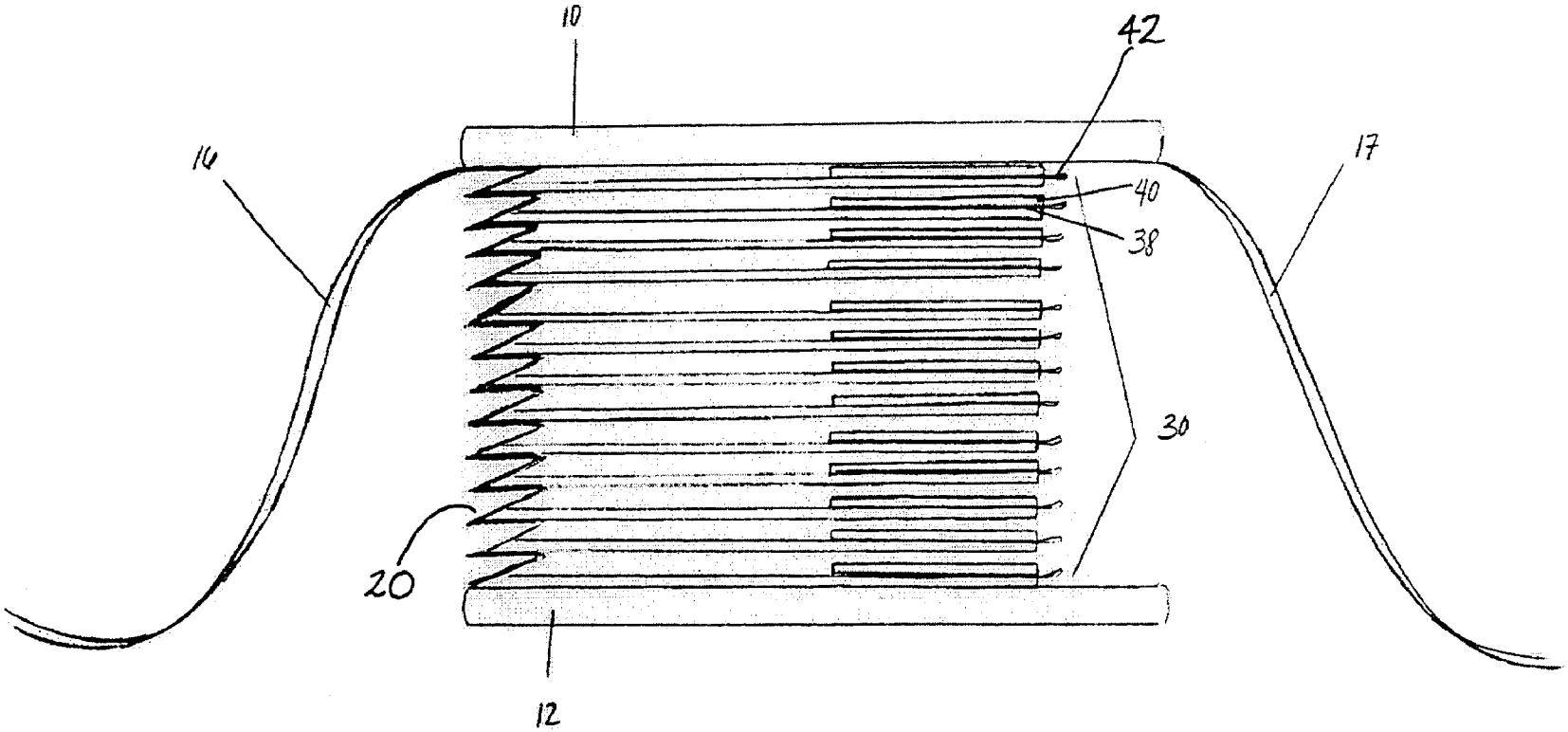
FIG. 5 is a schematic end view of the first embodiment in a substantially closed condition.

FIG. 5 shows the book substantially closed, with the carrier sheet folded so that the bottom side of each first section lies against the bottom side of a second section, the front sides on the first and second sections having the bottom edges of the envelopes sandwiched therebetween. This would result in the book being substantially thicker along the carrier side than along the free top edges of the envelopes, but for the compensating thickness of the tags 40 fixed to the flaps 38. That is, the tags 40 serve as shims so that the stack of envelopes 30 between the covers 10, 12, is substantially square. Tabs 42 not only facilitate opening the book at a desired envelope 30, but are also decorative. A flexible strip having opposite ends 16, 17, preferably an ornate ribbon, is fixed to the front cover 10 and is used to bind the covers so that the keepsake book remains in a closed position. This strip may be sandwiched between a liner of the cover 10 and the cover itself, and held in place by glue. The strip may alternatively be fixed to the back cover 12 of the keepsake book.

Figure 6:
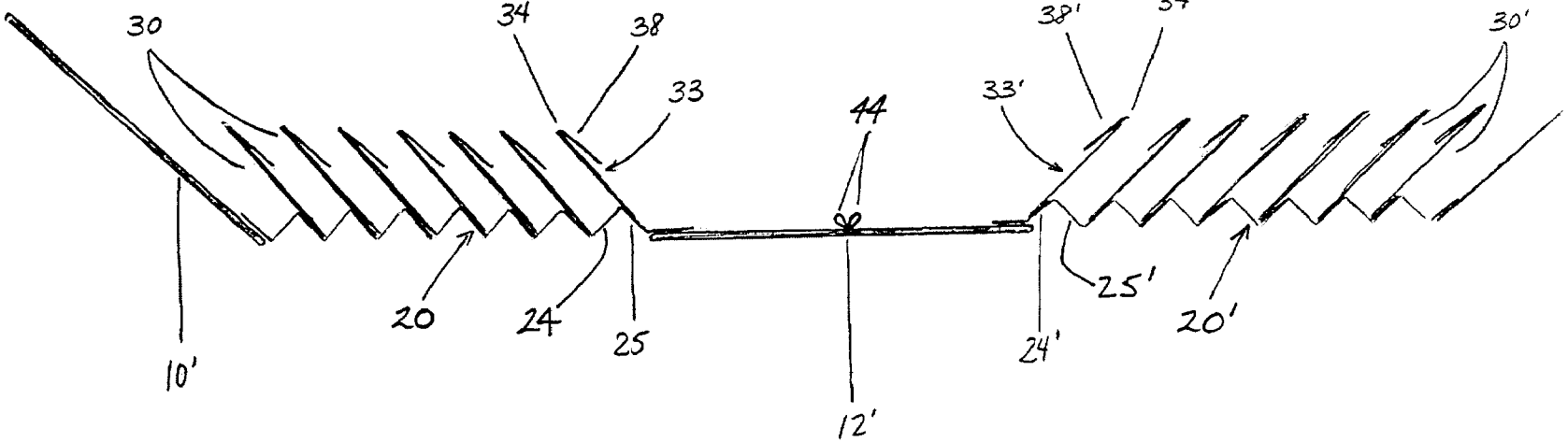
FIG. 6 is a schematic end view of the second embodiment in a partially open condition.

FIG. 6 is a schematic end view of a second embodiment of keepsake book according to the invention, wherein additional or modified elements will be identified by primed reference numerals. Here the front cover 10' and back cover 12' are considerably wider than the corresponding covers 10, 12 according to the first embodiment, the back cover 12' having both a first fanfolded carrier sheet 20 and a second fanfolded carrier sheet 20' fixed thereto. A first plurality of envelopes 30 are fixed to the second sections 25 of the first fanfolded carrier sheet 20 so that each flap 38 extends from a top edge 34 toward the right when the flaps 38 are folded against the back sides 33 of the envelopes 30. A second plurality of envelopes 30' are fixed to the first sections 24' of the second fanfolded carrier sheet 20' so that each flap 38' extends from a top edge 34' toward the left when the flaps 38' are folded against the back sides 33' of the envelopes 30'. The second fanfolded carrier sheet 20' and envelopes 30' are therefore mirror symmetric to the first fanfolded carrier sheet 20 and envelopes 30 when the keepsake book is open so that the carrier sheets 20, 20' extend oppositely from each other. This permits two guests to access the envelopes at once. A pair of loops 44 are provided for pens.

Figure 7:
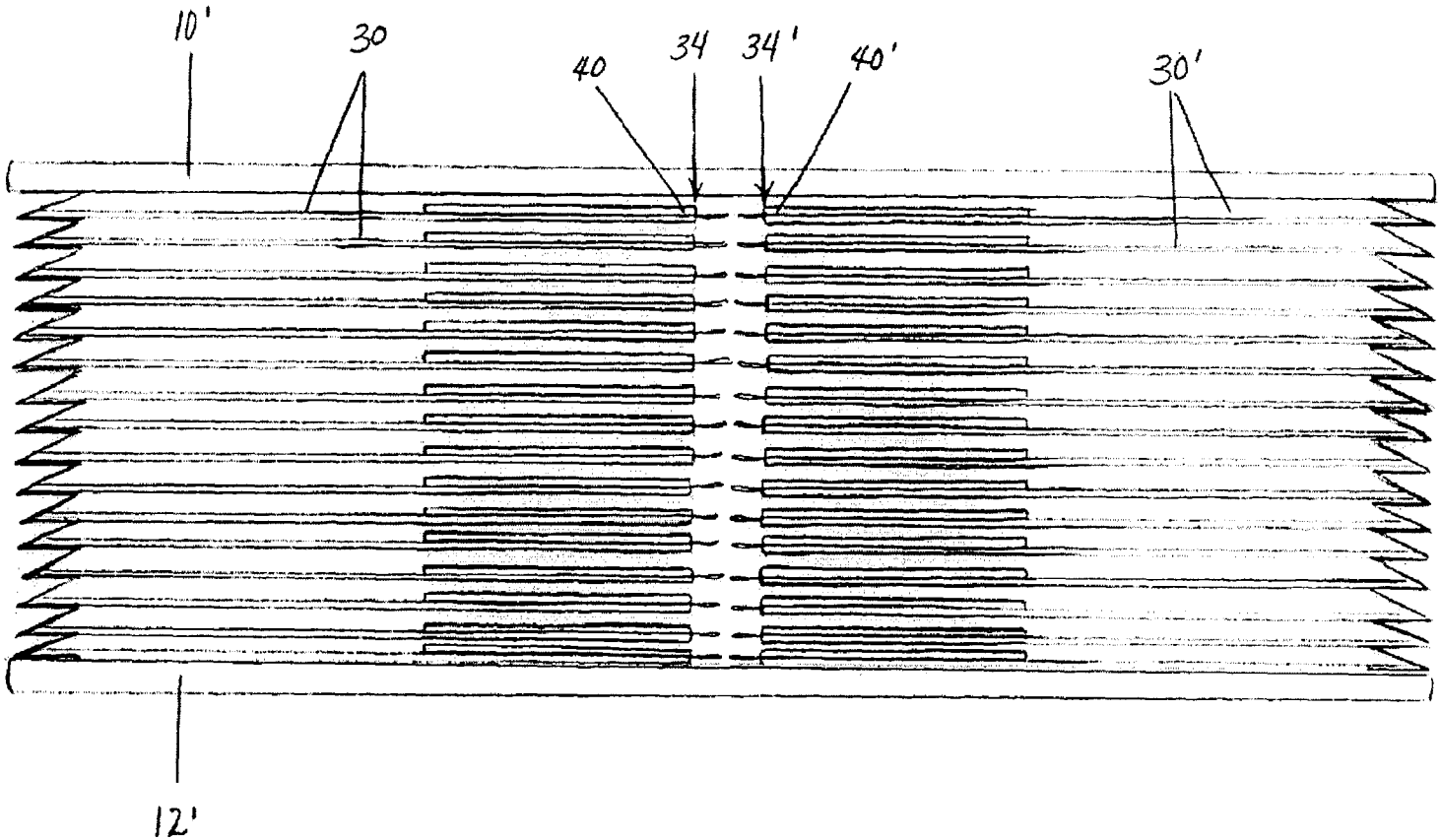
FIG. 7 is a schematic end view of the second embodiment in a substantially closed condition.

FIG. 7 shows the second embodiment of the keepsake book substantially closed, with both carrier sheets folded so that the bottom side of each first section lies against the bottom side of a second section, the front sides on the first and second sections having the bottom edges of the envelopes sandwiched therebetween. The envelopes 30, 30' form two stacks, the top edges 34, 34' being in mutually facing relationship, the tags 40, 40' acting as shims so that the stacks are square. The front cover 10' is sufficiently wide to extend over both stacks of envelopes 30, 30', and may be provided with ribbons or other securing means to fix the front cover 10' with respect to the back cover 12', i.e., to hold the book in a closed position.

According to a preferred embodiment, the width of the sections of the carrier sheet, shown as W in FIG. 2, is about ⅞". Since the envelopes are only attached to alternate sections, the envelopes will overlap with an exposed portion having a width 2W=1¾" when the carrier sheet is laid open so that the sections are substantially coplanar. Since the envelopes are substantially wider, typically about 5", this creates a pleasing shingle-like overlap when the book is open to a display configuration.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A keepsake book comprising:

a fanfolded carrier sheet having a top side, a bottom side, and alternating first and second sections separated by parallel folds; and a plurality of envelopes each having a front side, a back side, a top edge, a bottom edge opposite from said top edge, and a flap foldable from said top edge against said back side, said envelopes being non-removably fixed adjacent their bottom edges to the top side of respective said first sections, whereby, said envelopes form a stack when said carrier sheet is folded so that said first sections lie against respective said second sections, and said envelopes overlap with a portion adjacent to the top edge of each envelope exposed when said carrier sheet is unfolded.

2. A keepsake book as in claim 1 wherein the front sides of said envelopes adjacent their bottom edges are fixed to said first sections of said carrier sheet, whereby said flaps are exposed when said flaps are folded against respective said back sides of said envelopes and said carrier sheet is unfolded.

3. A keepsake book as in claim 2 further comprising a plurality of tags fixed to respective said flaps so that said tags are at least partially exposed when said flaps are folded against respective said back sides of said envelopes and said carrier sheet is unfolded.

4. A keepsake book as in claim 3 wherein said tags are each provided with at least one information line.

5. A keepsake book as in claim 4 wherein said tags are oriented so that said lines are transverse to said edges of said envelope.

6. A keepsake book as in claim 3 wherein said carrier sheet, said envelopes, and said tags each have a thickness which is chosen so that said envelopes form a substantially square stack when said carrier sheet is folded so that said first sections lie against respective said second sections.

7. A keepsake book as in claim 3 further comprising a plurality of tabs extending outward from said top edges of respective said envelopes, each said tab being fixed between a respective said tag and a respective said flap.

8. A keepsake book as in claim 7 wherein each said tab is formed as a loop of ribbon.

9. A keepsake book as in claim 1 further comprising a front cover and a back cover, said carrier sheet having a first end connected to said front cover and a second end connected to said back cover.

10. A keepsake book as in claim 9 further comprising means for fixing the front cover with respect to the back cover when said envelopes form a stack and said covers are parallel.

11. A keepsake book as in claim 10 wherein said means for fixing the front cover with respect to the back cover comprises at least one strip of material fixed to one of said covers.

12. A keepsake book as in claim 9 wherein said fanfolded carrier sheet is a first fanfolded carrier sheet and said plurality of envelopes is a first plurality, said front cover and said back cover extending substantially beyond said top edges of said envelopes when said envelopes form a stack, said keepsake book further comprising:

a second said fanfolded carrier sheet having a first end which is not connected to said front cover and a second end connected to said back cover remotely from said second end of said first carrier sheet;

a second plurality of said envelopes fixed adjacent their bottom edges to the top side of respective said second sections of said second fanfolded carrier sheet, whereby, said envelopes form first and second stacks when said carrier sheets are folded so that said first sections lie against respective said second sections, and said first cover can be closed over both of said stacks.

13. A keepsake book as in 12 wherein said second plurality of envelopes are fixed to said second fanfolded carrier so as to be mirror symmetric to said envelopes fixed to said first carrier sheet when said carrier sheets are open to extend oppositely from each other.

14. A keepsake book as in claim 13 wherein said flaps of each plurality of envelopes extend from respective said top edges toward the other plurality of envelopes when said flaps are folded against respective said back sides of said envelopes.

15. A keepsake book as in claim 1 wherein said envelopes are fixed to said carrier sheet by permanent adhesive.

16. A keepsake book as in claim 1 wherein each said section has a width W measured between said folds, and each said envelope has a width measured between said top edge and said bottom edge, said width of said envelope being substantially larger than the width of said sections, whereby, said envelopes overlap with a portion having a width 2W exposed when said carrier sheet is unfolded so that said sections are substantially coplanar.

17. A method of creating a keepsake book, said method comprising:

providing a fanfolded carrier sheet having a plurality of envelopes non-removably fixed thereto, said carrier sheet comprising alternating first and second sections separated by parallel folds, said envelopes each having a front side, a back side, a top edge, a bottom edge opposite from said top edge, and a flap foldable from said top edge against said back side, said envelopes being fixed adjacent their bottom edges to respective said first sections;

unfolding said carrier sheet so that said envelopes overlap with a portion adjacent to the top edge of each envelope is exposed;

inserting at least one item of memorabilia into at least one of said envelopes;

providing identifying information on the exposed portion of each said envelope; and folding said carrier sheet so that said first sections lie against said second sections and so that said envelopes form a stack.

18. A method as in claim 17 further comprising affixing a tag to the exposed portion of each said envelope, and entering said identifying information on said tag.

19. A method as in claim 17 wherein said front sides of said envelopes are fixed to respective said first sections so that said flaps are exposed when said flaps are folded against said back sides of said envelopes and carrier sheet is unfolded.

20. A method as in claim 17 further comprising providing a front cover and a back cover fixed to opposite ends of said carrier sheet; and providing means for fixing said front cover with respect to said back cover when said covers are closed against opposite sides of said stack; and fixing said front cover with respect to said back cover when said covers are closed against opposite sides of said stack.

* * * * *